United States Patent [19]

Mears

[11] 4,296,815

[45] Oct. 27, 1981

[54] DEFLECTOR WITH CONVERGING LOWER TINES FOR HORIZONTAL SPRINKLER

[75] Inventor: James W. Mears, Warwick, R.I.

[73] Assignee: Grinnell Fire Protection Systems Company, Inc., Cranston, R.I.

[21] Appl. No.: 128,818

[22] Filed: Mar. 10, 1980

[51] Int. Cl.[3] ..... A62C 37/08

[52] U.S. Cl. ..... 169/37; 239/498; 239/504; 239/DIG. 1

[58] Field of Search ..... 169/37, 38, 39, 40, 169/41, 42, 57, 66, 68, 90; 239/498, 504, 518, 524, DIG. 1

[56] References Cited

U.S. PATENT DOCUMENTS

| | | | |
|---|---|---|---|
| 608,677 | 8/1888 | Hibbard | 169/39 |
| 2,076,483 | 4/1937 | Rowley | 239/498 |
| 2,530,779 | 11/1950 | Owbridge | 239/DIG. 1 X |
| 3,904,126 | 9/1975 | Allard | 169/37 X |
| 4,099,675 | 7/1978 | Wohler et al. | 169/37 X |

*Primary Examiner*—Robert J. Spar
*Assistant Examiner*—Fred A. Silverberg

[57] ABSTRACT

A horizontal-sidewall, fire-protection sprinkler head including a spray deflector with a downwardly-extending slot that is substantially narrower in width at a first, outer location than at a second, inner location, wherein the slot has the effect of raising the trajectory of fluid passing through it.

6 Claims, 7 Drawing Figures

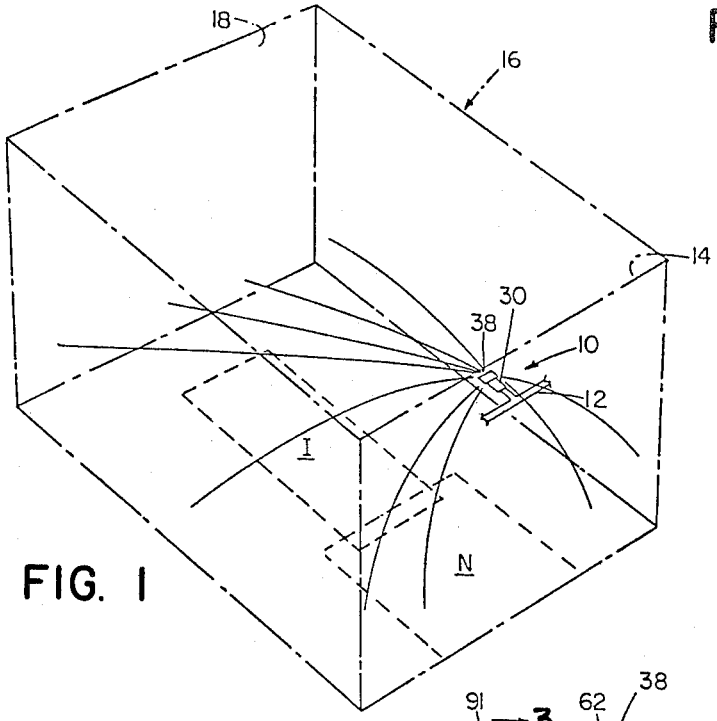
FIG. 1
FIG. 4
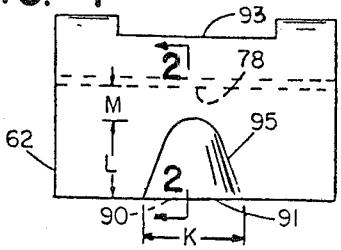
FIG. 3
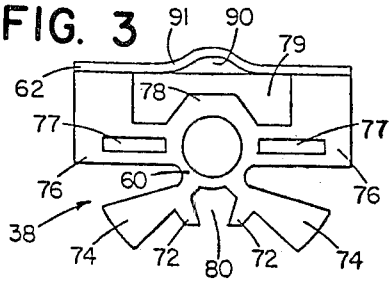
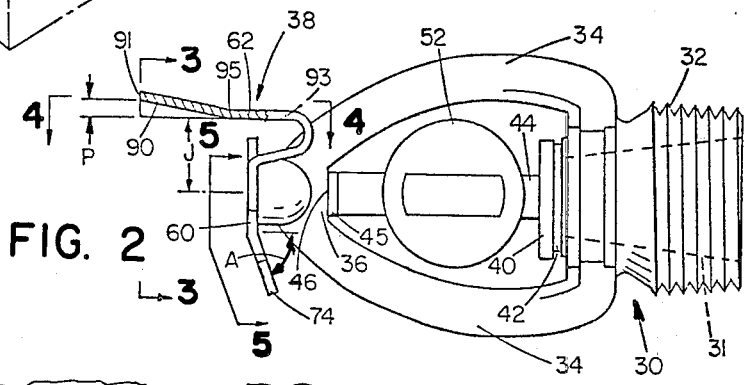
FIG. 2
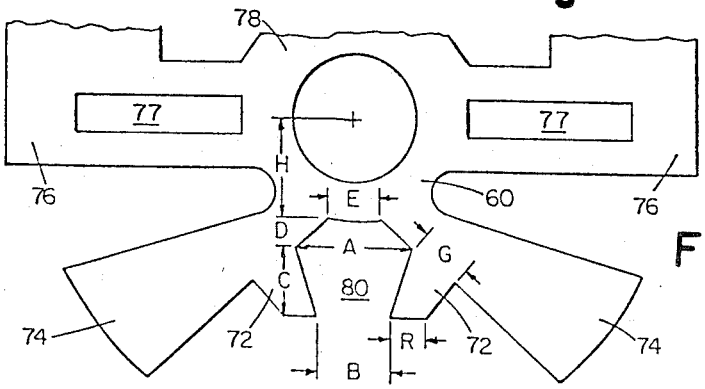
FIG. 5
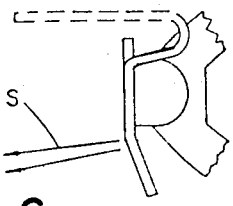
FIG. 6 PRIOR ART
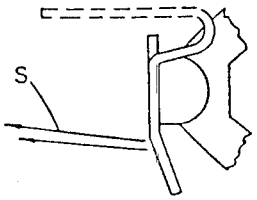
FIG. 7

DEFLECTOR WITH CONVERGING LOWER TINES FOR HORIZONTAL SPRINKLER

FIELD OF THE INVENTION

This invention relates to fire-protection sprinkler heads of the horizontal-sidewall type.

BACKGROUND OF THE INVENTION

Fire protection sprinkler heads generally include a deflector plate for distributing a spray of water (or other fire retardant fluid) over a wide area. The deflector plate is attached to one end of the sprinkler head frame and positioned in the path of the stream of water that emerges from the throat of the sprinkler head at the opposite end of the frame and which is connectable to the source of water under pressure.

In the case of horizontal-sidewall sprinkler heads, which are typically mounted near the top of a vertical wall, the stream of water emerges horizontally from the throat and strikes a portion of the sprinkler head frame as well as the deflector plate. The deflector plate of horizontal-sidewall sprinklers usually consists of a primarily planar surface, more nearly horizontal than vertical, which is interconnected with a series of fluid deflecting elements that are more nearly vertical than horizontal.

The purposes of the primarily planar surface are to confine the upward trajectory of the spray of water as well as distribute a portion of it over the far reaches of the area to be protected by the sprinkler head. The principle purpose of the nearly vertical fluid deflecting elements is to distribute a portion of the spray of water over the area closer to the sprinkler head.

This invention relates to a particular configuration of the fluid deflecting elements which has been found to provide an improved means of distributing a portion of the spray over an area intermediate in distance from the sprinkler head.

SUMMARY OF THE INVENTION

I have found that improved uniformity in spray can be achieved by so shaping the essentially vertical fluid deflecting elements (commonly referred to as tines), projecting downward beneath the axis of the throat, such that the slots between them grow narrower progressing in the downward direction. My observations show that this shape slot causes water passing through the slot to be given a trajectory inclined toward the centerline (or throat axis) of the sprinkler head. I have realized that by using such a slot in a horizontal-sidewall deflector, the slot provides improved spray coverage ahead of the sprinkler head, generally in the middle of the area to be covered, by giving a raised trajectory to water passing through the slot. Horizontal sidewall sprinklers typically direct too much water downward onto the floor below the sprinkler (adjacent to the near wall) as well as to the far reaches of the area to be covered and too little water toward the center of the area. The principal cause of this uneven distribution is that the flow path downstream of the throat is typically obstructed along the centerline of the sprinkler, e.g., by the deflector hub and by arms supporting the deflector. The new slot configuration raises the trajectory of water passing through it, sending water into the shadow of these obstructions, and thereby increasing the spray density at the center of the area to be covered by the sprinkler head.

PREFERRED EMBODIMENT

The structure of a preferred embodiment of the invention will now be described, after first briefly describing the drawings.

DRAWINGS

FIG. 1 is a perspective view of said embodiment installed on one vertical wall of a room.

FIG. 2 is a side view, partially cross sectioned, of said embodiment.

FIG. 3 is an enlarged frontal view of the deflector taken at 3—3 of FIG. 2.

FIG. 4 is a top view of the deflector taken at 4—4 of FIG. 2.

FIG. 5 is a fragmentary view of the lower half of the deflector taken at 5—5 of FIG. 3.

FIG. 6 is a diagrammatic side view of the deflector showing the fluid trajectory achieved with typical prior art deflectors.

FIG. 7 is the same view as FIG. 6 showing the improved trajectory achieved with the slot of the invention.

STRUCTURE

Turning to FIG. 1, there is shown a horizontal sidewall sprinkler 10 installed in supply pipe 12 near the top center of wall 14 of a rectangular room 16 (indicated in broken lines). For reference purposes, wall 14, on which the sprinkler is mounted, is referred to as the near wall. Wall 18, opposite the sprinkler, is the far wall.

The sprinkler head is shown in cross section in FIG. 2. Body 30 (a machined bronze casting) has an internal passage or throat 31 for discharging water and threads 32 for attachment to a supply fitting. Integral arms 34 extend outward from body 30 to element 36, to which is attached deflector plate 38. Throat 31 (a frustoconical interior surface running along the horizontal axis through body 30) is normally sealed shut by button 40 and gasket 42, which are supported by strut 44. The opposite end of strut 44 rests in a groove in hook 45, the groove being offset slightly from fulcrum 46 on element 36, to provide mechanical advantage. Hook 45 is secured to the strut via a key member (not shown), a solder layer (not shown), and bell-shaped heat collector 52.

Turning to FIG. 3, there is shown a frontal view of deflector plate 38, which is cut from brass (0.049 to 0.053 inches thick). Extending from central hub portion 60 are a plurality of differently sized and shaped deflector elements 72, 74, 76, 78. Tines 72, 74 are bent back to an angle A (about 70°) (FIG. 2) from the horizontal plane of the central hub. Small tines 72 converge toward each other. Between tines 72 there is formed a slot 80, best seen in FIG. 5. The width of slot 80, over length D (0.06 inches), initially increases for greater radial distances from the hub to a maximum width A (0.26 inches), and then, over length C (0.14 inches), decreases, due to the converging orientation of tines 72, to a width B (0.16 inches). The root dimension E of slot 80 is approximately 0.12 inches. Converging tines 72 each have a dimension G of 0.12 inches at their base and a dimension R of 0.08 inches at their tip. The top of slot 80 is spaced a dimension H of 0.22 inches below the center of hub 60.

Above central hub 60 there is provided a confining element 62, extending outward horizontally (perpendicular to the vertical plane of the hub). The lower surface of the confining element is spaced a dimension J of about 0.39 inches above the center of the hub. The confining element is upwardly deformed at its downstream center to form channel 90, which extends upstream from downstream end 91 of element 62 by a dimension L (0.44 inches), to a point about midway between end 91 and upstream end 93. In plan view (FIG. 4), the boundary 95 between channel 90 and the surrounding flat-undeformed areas is generally parabolic in shape, with the vertex of the parabola at the upstream end of the channel. Undeformed areas surround the channel on both lateral sides and upstream. The undersurface of the channel is arcuate (upwardly concave and tapering, approximating a conical surface) with a radius of about 0.27 inches at downstream end 91, and the centerline of the undersurface is inclined at an angle of from 10° to 12° with respect to the undeformed areas. The channel smoothly merges into the undeformed area, with a fillet radius at boundary 95 of about 0.27 inches, the same as the maximum radius of the undersurface of the channel. The downstream mouth of the channel has a width K of 0.56 inches and a vertical depth (or height) P of about 0.08 inches. The upstream end of the channel is a distance M (about 0.20 inches) downstream of the upstream surface of tine 78 on the deflector hub.

OPERATION

When the sprinkler is activated (by fusing of the solder layer), strut 44 and button 40 are released, and water (or other fire-retardant liquid) flows through throat 31 in a stream directed at deflector plate 38, which produces and distributes a spray in a generally rectangular pattern to match the size of room 16. The sprinkler is designed to deliver a spray pattern of an acceptable minimum density throughout an area sixteen feet wide and twenty four feet long. Water is primarily directed at the floor and lower wall areas, including the near, side and far walls. As the height and contour of the ceiling above the sprinkler can vary for each installation, the ceiling is not depended upon to deflect the spray.

Each portion of deflector plate 38 serves a separate function in distributing the spray. Lower tines 74 distribute water onto the near wall and adjacent floor area (e.g., the first ten feet of floor). Long rectangular slots 77 distribute water onto the intermediate floor area. Confining element 62, upper tine 78, and aperture 79 control the distribution of water at the far wall and far floor area. Upper tine 78 causes water passing through aperture 79 to spread out in a fan-shaped horizontal spray. The width of aperture 79 determines the width of the horizontal spray. Confining element 62 directs the fan-shaped spray below the ceiling toward the far areas of the room.

To correct the otherwise low water density which can occur in intermediate region I, small lower tines 72 are used to raise the trajectory of water passing through the slot 80 between the tines. Tests have shown that it is important to shape the slot so it narrows radially, preferably first widening and then narrowing. FIGS. 6 and 7 compare the performance of the new deflector (FIG. 7) with that of a typical prior art deflector not having the narrowing slot (FIG. 6). With the straight or diverging tines and widening slot typical of the prior art, the flow steam S passing through slot 80 becomes angled downward. With the narrowing slot of the invention, the portions of the stream emerging from slot 80 are angled upward slightly. The net result is that some of the water that would be deflected downward into the near region N (FIG. 1) below the sprinkler is directed into intermediate region I.

An explanation for this phenomena is that portions of the water stream are curved inward as they follow the converging shape of the tines and that, at the narrow region between the tips of the tines, the portion following the left tine impinges on the portion following the right tine, to generate an upward deflecting motion to the water flowing through the middle section of slot 80.

Other embodiments of the invention are within the following claims. For example, more than one converging slot could be provided.

OTHER INVENTIONS

Subject matter relating to channel 90 in hat 62 was the invention of Michael A. Fischer, and his invention was subsequent to mine.

What is claimed is:

1. A fire protection sprinkler head including a throat through which a nearly horizontal stream of fire retardant fluid can flow and a deflector spaced downstream from the flow emerging out of said throat, said deflector including a generally planar confining element more nearly horizontal than vertical which is positioned above the longitudinal axis of said throat for the purpose of confining the upward trajectory of a portion of the stream and a plurality of fluid-deflecting elements positioned below the confining element for the purpose of deflecting and distributing other portions of the stream, some of said fluid-deflecting elements defining between themselves a plurality of slots extending generally outwardly from beneath said axis, at least one of said slots extending generally downward from said axis, the improvement wherein said downwardly-extending slot is substantially narrower in width at its outermost extremity than at an intermediate location that is closer to said axis, so as to raise the trajectory of fluid passing through said slot.

2. The sprinkler head of claim 1 wherein said downwardly-extending slot is defined by two generally downwardly-extending tines.

3. The sprinkler head of claim 2 wherein the outward extending portions of said two tines converge toward each other.

4. The sprinkler head of claim 3 wherein said downwardly-extending slot is located directly below said axis and thereby raises the trajectory of a portion of the fluid stream travelling generally beneath said axis.

5. The sprinkler head of claim 3 wherein
there are a further two tines, said further tines extending laterally and downwardly from said axis, and
each of said converging tines extend downwardly from a respective one of said further tines.

6. The sprinkler head of claims 1 or 5 wherein the width of said downwardly-extending slot at its innermost extremity closest to said axis is less than at said intermediate location, so that the width of said downwardly-extending slot increases and then diminishes progressing downwardly beneath said axis.

* * * * *